US010474072B2

(12) United States Patent
Mita

(10) Patent No.: US 10,474,072 B2
(45) Date of Patent: Nov. 12, 2019

(54) FIXING APPARATUS AND IMAGE PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Katsutoshi Mita, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/922,244

(22) Filed: Mar. 15, 2018

(65) Prior Publication Data

US 2019/0286030 A1 Sep. 19, 2019

(51) Int. Cl.

| | |
|---|---|
| ***G03G 15/20*** | (2006.01) |
| ***G03G 15/01*** | (2006.01) |
| ***G03G 15/00*** | (2006.01) |

(52) U.S. Cl.

CPC ..... *G03G 15/2039* (2013.01); *G03G 15/0105* (2013.01); *G03G 15/2053* (2013.01); *G03G 15/55* (2013.01); *G03G 2215/2038* (2013.01)

(58) Field of Classification Search

CPC ..... G03G 15/2039; G03G 15/55; G03G 15/2053; G03G 15/0105; G03G 2215/2038

See application file for complete search history.

(56) References Cited

U.S. PATENT DOCUMENTS

| | | | | |
|---|---|---|---|---|
| 2006/0099001 A1* | 5/2006 | Asakura | ..... | G03G 15/2042 399/69 |
| 2014/0056606 A1* | 2/2014 | Hasegawa | ..... | G03G 15/2039 399/67 |

FOREIGN PATENT DOCUMENTS

| | | | |
|---|---|---|---|
| JP | 2005257902 A | | 9/2005 |
| JP | 2006126565 A | | 5/2006 |
| JP | 2007108372 A | | 4/2007 |
| JP | 2008275873 A | | 11/2008 |
| JP | 2009069858 A | * | 4/2009 |
| JP | 2016218239 A | * | 12/2016 |
| JP | 2016218239 A | | 12/2016 |

* cited by examiner

*Primary Examiner* — Susan S Lee
(74) *Attorney, Agent, or Firm* — Kim & Stewart LLP

(57) ABSTRACT

A fixing apparatus comprises a rotating body that conveys a sheet in a first direction, first and second heating sections, and first and second temperature detectors. In the first heating section, a calorific value per unit length in a second direction orthogonal to the first direction, at the center of the first heating section is larger than that at both ends thereof. In the second heating section, a calorific value per unit length in the second direction, at both ends of the second heating section is larger than that at the center thereof. The first temperature detector is configured to detect a temperature of a central part of a heating area of the rotating body heated by one of the first and second heating sections. The second temperature detector is configured to detect a temperature outside of the heating area of the rotating body.

16 Claims, 11 Drawing Sheets

FIXING APPARATUS AND IMAGE PROCESSING APPARATUS

FIELD

Embodiments described herein relate generally to a fixing apparatus and an image processing apparatus.

BACKGROUND

A conventional image processing apparatus has a fixing apparatus for fixing a toner image transferred onto a sheet. In the fixing apparatus, sheet is conveyed in a sheet conveyance direction by a rotating body such as a belt or a roller. The fixing apparatus has a heating section such as a halogen lamp for heating the sheet. The fixing apparatus has two heating sections in some cases. For example, one of the heating sections is a center lamp mainly heating a central part of the sheet in a direction orthogonal to the sheet conveyance direction. The other one of the heating sections is a side lamp mainly heating both ends in the direction orthogonal to the sheet conveyance direction.

For example, the fixing apparatus has three temperature sensors that detect a temperature of the rotating body. One of the three temperature sensors is a center temperature sensor which detects the temperature of a part of the rotating body that the center lamp mainly heats. The other one of the three temperature sensors is a side temperature sensor that detects the temperature of a part of the rotating body that the side lamp mainly heats. The remaining one of the three temperature sensors is a side temperature sensor that detects a temperature of a non-heating area of the rotating body which is not heated by any heating section.

DETAILED DESCRIPTION

In accordance with an embodiment, a fixing apparatus comprises a rotating body configured to convey a sheet in a first direction by rotating, a first heating section configured to heat the rotating body, a second heating section configured to heat the rotating body, a first temperature detector, and a second temperature detector. In the first heating section, a calorific value per unit length in a second direction orthogonal to the first direction, at the center of the first heating section in the second direction is larger than that at both ends of the first heating section in the second direction. In the second heating section, a calorific value per unit length in the second direction, at both ends of the second heating section in the second direction is larger than that at the center of the second heating section in the second direction. The first temperature detector is configured to detect a temperature of a central part of a heating area of the rotating body in the second direction, that is heated by at least one of the first heating section and the second heating section. The second temperature detector is configured to detect a temperature outside of the heating area of the rotating body in the second direction.

Hereinafter, an image processing apparatus of an embodiment is described with reference to the accompanying drawings.

Figure 1:
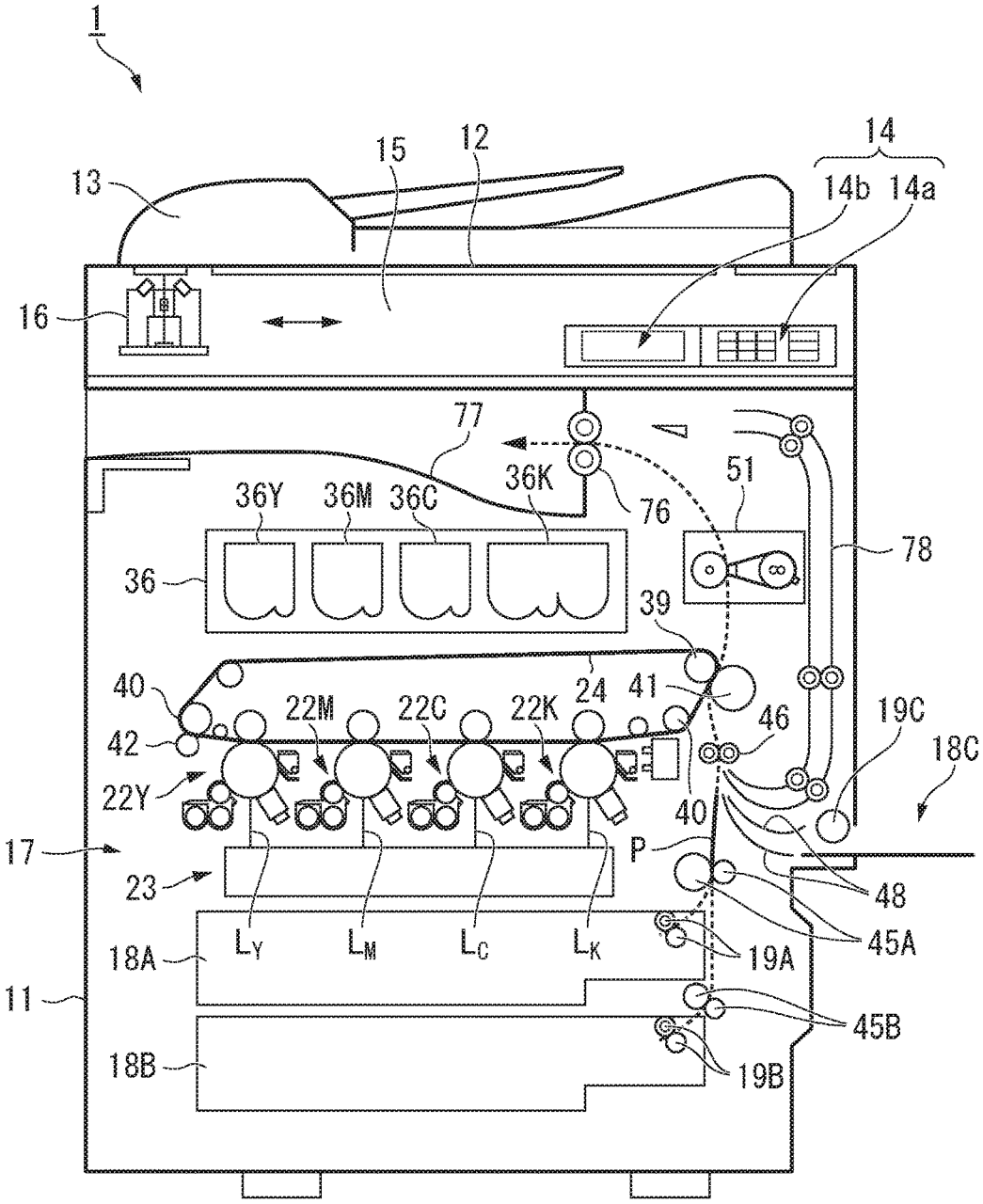
FIG. 1 is a schematic cross-sectional view illustrating an example of an image processing apparatus according to an embodiment.

As shown in FIG. 1, an image processing apparatus 1 of the present embodiment is, for example, an MFP (Multi-Function Peripherals), a printer, a copying machine, and the like. An example in which the image processing apparatus 1 is an MFP is described below.

The image processing apparatus 1 has a main body 11. At the top of the main body 11, a document table 12 including a transparent glass is provided. An automatic document feeder (ADF) 13 is provided on the document table 12. At the top of the main body 11, an operation section 14 is also provided. The operation section 14 includes an operation panel 14*a* having various keys and a touch panel type operation and display section 14*b*.

A scanner section 15 is provided below the ADF 13. The scanner section 15 reads an original document sent by the ADF 13 or an original document placed on the document table 12. The scanner section 15 generates image data of the original document. For example, the scanner section 15 includes an image sensor 16. For example, the image sensor 16 may be a contact type image sensor.

The image sensor 16 moves along the surface of the document table 12 at the time of reading an image on the original document placed on the document table 12. The image sensor 16 reads an original document for one page by each line of the document image.

When the image of the original document sent by the ADF 13 is read by the scanner section 15, the image sensor 16 reads the sent original document at a fixed position shown in FIG. 1.

The main body 11 has a transfer section 17 at a center thereof in the height direction. The main body 11 has sheet feed cassettes 18A and 18B around the bottom thereof and a manual sheet feed unit 18C on the side surface thereof.

The sheet feed cassettes 18A and 18B are arranged inside the main body 11. The sheet feed cassettes 18A and 18B are arranged to overlap in the order from the upper side to the lower side.

The manual sheet feed unit 18C protrudes outwardly from the side of the main body 11 below an inversion conveyance path 78 described later.

The sheet feed cassettes 18A and 18B accommodate sheets P of various sizes therein. The manual sheet feed unit 18C supports sheets P of various sizes thereon. The central axis in a conveyance orthogonal direction (i.e., width direction) of each of the sheets P of various sizes which is a direction orthogonal to a conveyance direction of the sheet P along a conveyance surface of the sheet P is positioned at a fixed position. The conveyance orthogonal direction is orthogonal to the conveyance direction and a thickness direction of the sheet P conveyed in the conveyance direction, respectively.

For example, the maximum length in the conveyance orthogonal direction of the sheet P used in the image processing apparatus 1 of the present embodiment is 215.9 mm which is a size of a letter paper in Europe and the United States. This maximum length may be 210 mm which is an A4 size conforming to the Japanese Industrial Standard.

The sheet feed cassette 18A (18B) includes a sheet feed mechanism 19A (19B). That the sheet feed cassette 18A (18B) has the sheet feed mechanism 19A (19B) means that the sheet feed cassette 18A has the sheet feed mechanism 19A and that the sheet feed cassette 18B has a sheet feed mechanism 19B. The same form is also used in the following description.

The sheet feed mechanism 19A (19B) picks up the sheets P one by one from the sheet feed cassette 18A (18B) and feeds it to a conveyance path of the sheet P. For example, the sheet feed mechanism 19A (19B) may include a pickup roller, a separation roller, and a sheet feed roller.

The manual sheet feed unit 18C has a manual sheet feed mechanism 19C. The manual sheet feed mechanism 19C picks up the sheets P one by one from the manual sheet feed unit 18C and feeds it to the conveyance path.

The transfer section 17 forms an image on the sheet P based on image data read by the scanner section 15 or image data received from outside of the image processing apparatus 1. The transfer section 17 is a color printer of a tandem system.

As shown in FIG. 1, the transfer section 17 includes image forming sections 22Y, 22M, 22C and 22K of yellow (Y), magenta (M), cyan (C), and black (K) colors, an exposure device 23, and an intermediate transfer belt 24. In the present embodiment, the transfer section 17 has four image forming sections 22Y, 22M, 22C and 22K. The transfer section 17 has so-called quadruple image forming sections.

The configuration of the transfer section 17 is not limited thereto, and the transfer section may include two or three image forming sections, or the transfer section may include five or more image forming sections.

The image forming sections 22Y, 22M, 22C and 22K are arranged below the intermediate transfer belt 24. The image forming sections 22Y, 22M, 22C and 22K are arranged along the lower surface of the outer circumferential surface of the intermediate transfer belt 24.

The exposure device 23 irradiates exposure light $L_Y$, $L_M$, $L_C$ and $L_K$ to the image forming sections 22Y, 22M, 22C and 22K, respectively. The exposure device 23 may be constituted to generate a laser scanning beam as the exposure light. The exposure device 23 may include a solid-state scanning element such as an LED (Light Emitting Diode) for generating the exposure light.

The configurations of the image forming sections 22Y, 22M, 22C and 22K are common to each other except that the colors of the toner therein are different. Either a non-decolorable toner or a decolorable toner may be used as the toner. The decolorable toner becomes transparent if heated at a predetermined temperature or higher corresponding to the toner. The image processing apparatus 1 may be an image processing apparatus that can use the decolorable toner or an image processing apparatus that cannot use the decolorable toner.

Hereinafter, the constitution shared by the image forming sections 22Y, 22M, 22C and 22K is described by using the image forming section 22K as an example.

Figure 2:
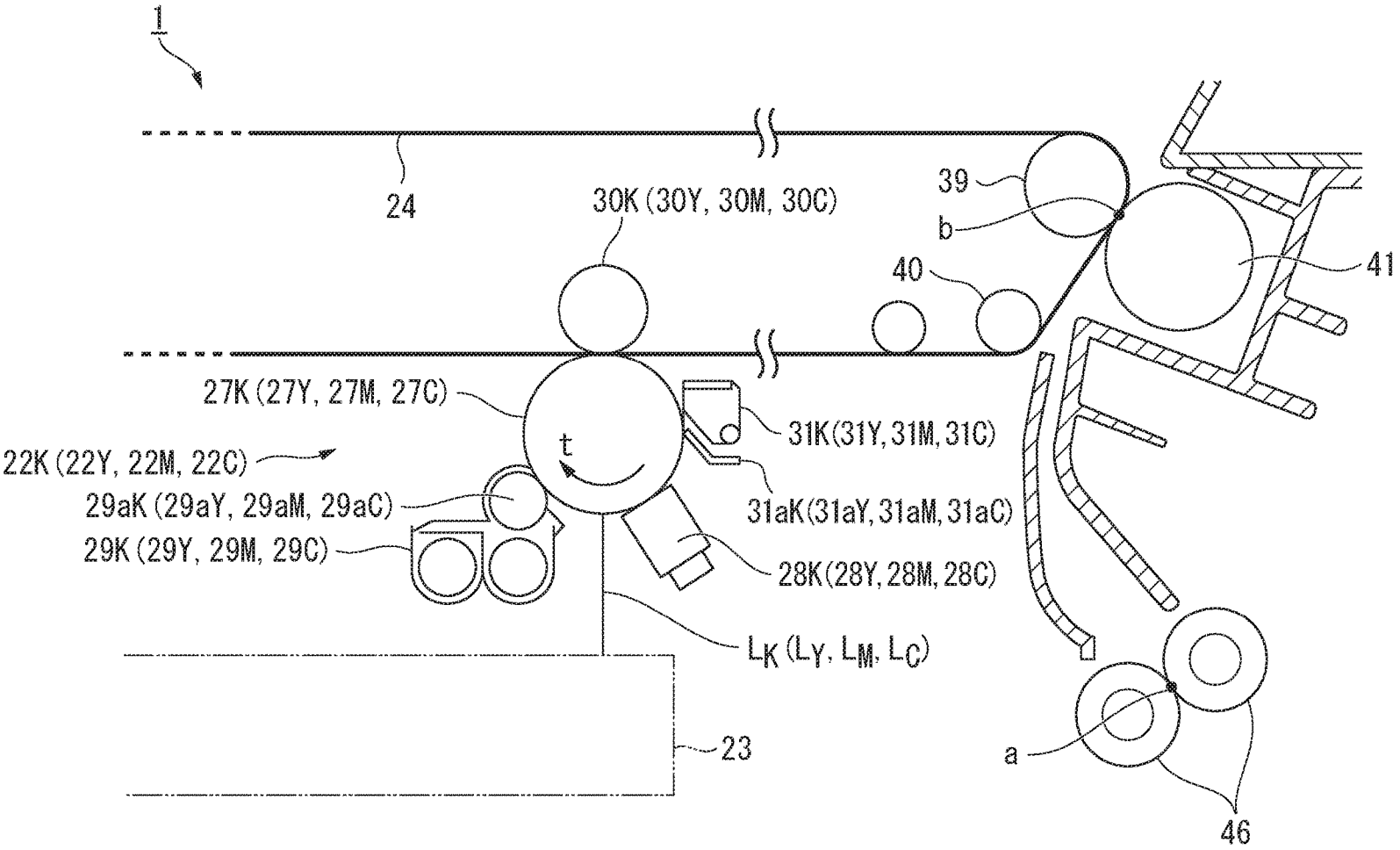
FIG. 2 is an enlarged view of the periphery of an image forming section in FIG. 1.

As shown in FIG. 2, the image forming section 22K has a photoconductive drum 27K. The photoconductive drum 27K rotates in a rotation direction t. A charging device 28K, a developing device 29K, a primary transfer roller 30K and a cleaner 31K are arranged around the outer circumferential surface of the photoconductive drum 27K along the rotation direction t.

The charging device 28K of the image forming section 22K uniformly charges the outer circumferential surface of the photoconductive drum 27K.

The exposure device 23 generates the exposure light $L_K$ modulated based on the image data. The exposure light $L_K$ exposes the outer circumferential surface of the photoconductive drum 27K. The exposure device 23 forms an electrostatic latent image on the photoconductive drum 27K.

The developing device 29K supplies black toner to the electrostatic latent image formed on the photoconductive drum 27K by a developing roller 29*a*K to which a developing bias is applied. By supplying black toner, the developing device 29K develops the electrostatic latent image on the photoconductive drum 27K.

The cleaner 31K has a blade 31*a*K abutting against the photoconductive drum 27K. The blade 31*a*K removes toner remaining on the surface of the photoconductive drum 27K (i.e., residual toner) after a primary transfer is performed.

The image forming sections 22Y, 22M and 22C are provided with the photoconductive drums 27Y, 27M and 27C, charging devices 28Y, 28M and 28C, primary transfer rollers 30Y, 30M and 30C, cleaners 31Y, 31M and 31C which are respectively similar, in its structure, to the photoconductive drum 27K, the charging device 28K, the primary transfer roller 30K, and the cleaner 31K of the image forming section 22K.

The image forming sections 22Y, 22M and 22C have developing devices 29Y, 29M, and 29C differing only in the toner color from the developing device 29K of the image forming section 22K.

As shown in FIG. 1, above the image forming sections 22Y, 22M, 22C and 22K, a supply section 36 is arranged.

The supply section 36 supplies the toner to the developing devices 29Y, 29M, 29C and 29K through a supplying mechanism including a pipe and an auger, respectively. The supply section 36 has toner cartridges 36Y, 36M, 36C and 36K. The toner cartridges 36Y, 36M, 36C and 36K store a yellow toner, a magenta toner, a cyan toner, and a black toner, respectively.

In each of the toner cartridges 36Y, 36M, 36C and 36K, a marking part (not shown) is provided which is used for the main body 11 to detect the type of toner stored in each of the toner cartridges 36Y, 36M, 36C and 36K. The marking part is formed to correspond to at least information on the color of the toner in the toner cartridges 36Y, 36M, 36C and 36K and information for identifying whether it is the normal toner or the decolorable toner.

The intermediate transfer belt 24 is an endless belt and rotates. The intermediate transfer belt 24 is wrapped around a driving roller 39 and a plurality of driven rollers 40.

As shown in FIG. 2, the outer circumferential surface of the intermediate transfer belt 24 is in contact with upper portions of the photoconductive drums 27Y, 27M, 27C and 27K.

At a position above the photoconductive drum 27K (27Y, 27M, 27C) and opposite to the photoconductive drum 27K (27Y, 27M, 27C) across the intermediate transfer belt 24, the primary transfer roller 30K (30Y, 30M, 30C) is arranged. The primary transfer roller 30K (30Y, 30M, 30C) is arranged inside the intermediate transfer belt 24.

If a primary transfer voltage is applied, the primary transfer roller 30K (30Y, 30M, 30C) transfers the toner image on the photoconductive drum 27K (27Y, 27M, 27C) onto the intermediate transfer belt 24 to perform a primary transfer.

A secondary transfer roller 41 is opposed to the driving roller 39 across the intermediate transfer belt 24. The abutment part between the intermediate transfer belt 24 and the secondary transfer roller 41 constitutes a secondary transfer position b. The driving roller 39 rotationally drives the intermediate transfer belt 24.

A secondary transfer voltage is applied to the secondary transfer roller 41 at the time the sheet P passes through the secondary transfer position b. If the secondary transfer voltage is applied to the secondary transfer roller 41, the secondary transfer roller 41 transfers the toner image on the intermediate transfer belt 24 onto the sheet P to perform a secondary transfer.

As shown in FIG. 1, a belt cleaner 42 is arranged at a position facing one of a plurality of the driven rollers 40 across the intermediate transfer belt 24. The belt cleaner removes the residual transfer toner on the outer circumferential surface of the intermediate transfer belt 24 from the intermediate transfer belt 24.

A sheet feed roller 45A and a registration roller 46 are arranged along the conveyance path from the sheet feed cassette 18A to the secondary transfer roller 41. The sheet feed roller 45A conveys the sheet P taken out from the sheet feed cassette 18A toward the registration roller 46 by the sheet feed mechanism 19A.

The registration roller 46 aligns the position of the tip of the sheet P fed from the sheet feed roller 45A at a mutual contact position thereof. The mutual contact position in the registration roller 46 (refer to point a in FIG. 2) constitutes a registration position. When the tip of the toner image on the intermediate transfer belt 24 reaches the secondary transfer position b, the registration roller 46 conveys the sheet P such that the tip of a transfer area of the sheet P, onto which the toner image will be transferred, reaches the secondary transfer position b at the same timing.

As shown in FIG. 1, a sheet feed roller 45B is provided on the conveyance path from the sheet feed cassette 18B to the sheet feed roller 45A. The sheet feed roller 45B conveys the sheet P taken out from the sheet feed cassette 18B by the sheet feed mechanism 19B towards the sheet feed roller 45A.

The conveyance path is formed by the conveyance guide 48 between the manual sheet feed mechanism 19C and the registration roller 46. The manual sheet feed mechanism 19C conveys the sheet P taken out from the manual sheet feed unit 18C towards the conveyance guide 48. The sheet P moving along the conveyance guide 48 reaches the registration roller 46.

At the downstream side (upper side in the figure) of the secondary transfer roller 41 in the conveyance direction of the sheet P, a fixing section (fixing apparatus) 51 is arranged to fix the transferred toner image on the sheet P.

Figure 3:
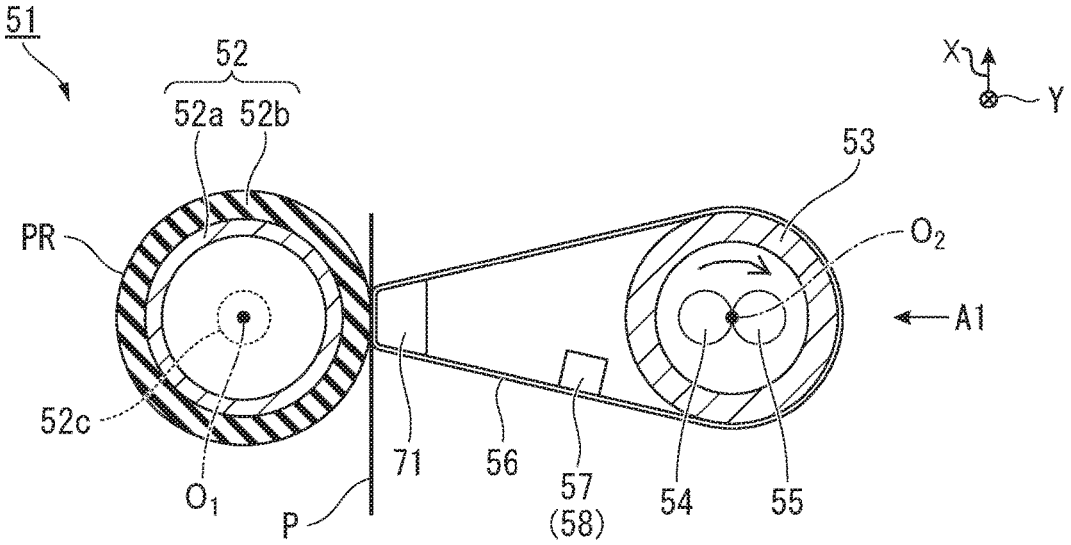
FIG. 3 is an enlarged view of the periphery of a fixing section in FIG. 1.
Figure 4:
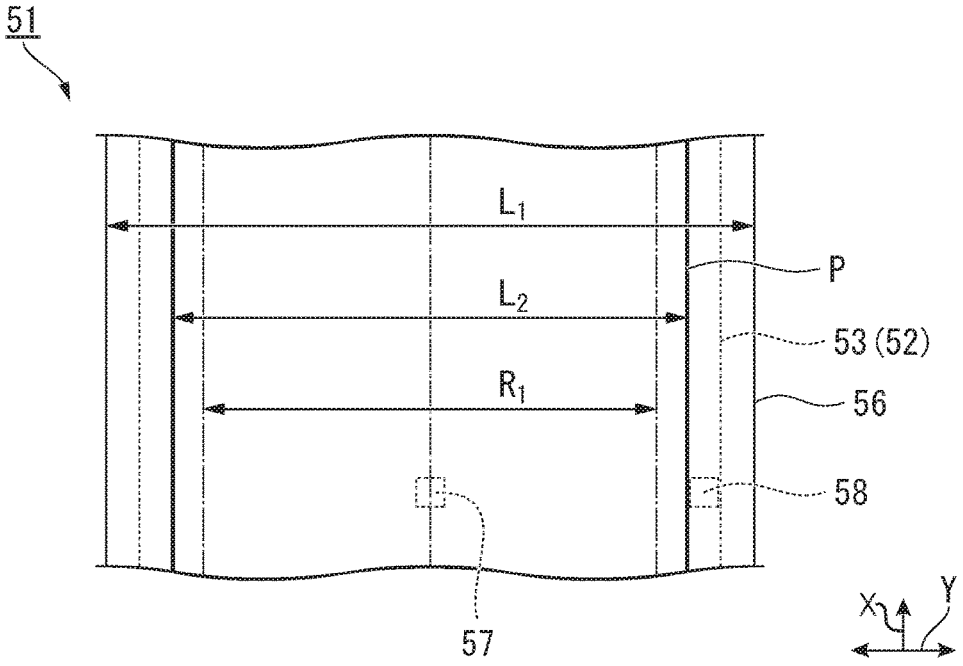
FIG. 4 is a side view of the periphery of the fixing section in FIG. 1.
Figure 5:
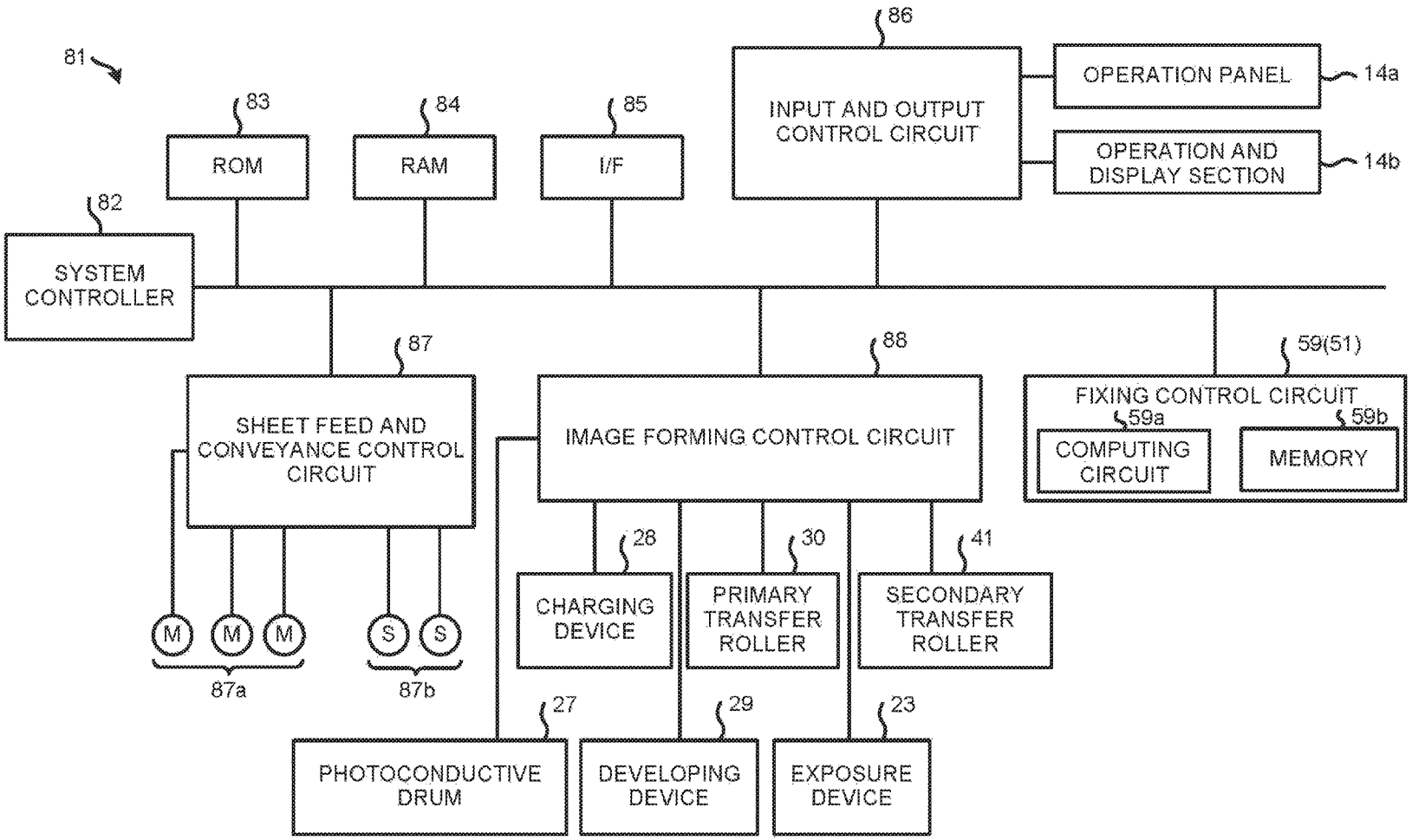
FIG. 5 is a block diagram illustrating an example of a controller of the image processing apparatus according to the embodiment.

As shown in FIG. 3 to FIG. 5, for example, the fixing section 51 includes a press roller 52, a heat roller 53, a center lamp 54, a side lamp 55, a fixing belt 56, one center temperature sensor 57, one out-of-area temperature sensor 58, a fixing control circuit 59. In the fixing section 51, the sheet P is conveyed in a conveyance direction X. The constitution of the fixing section 51 is not limited thereto.

The press roller 52 has a core 52*a* and an elastic layer 52*b*.

The core 52*a* is made of metal. At both ends of the core 52*a*, a rotary shaft 52*c* extends respectively. The rotary shaft 52*c* is coaxial with a central axis O. The rotating shaft 52*c* is rotatably supported by a supporting member (not shown) in the fixing section 51 via a bearing (not shown). The elastic layer 52*b* is formed on an outer peripheral surface of the core 52*a*. For example, the elastic layer 52*b* is composed of a rubber layer. The elastic layer 52*b* may be composed of a silicone rubber layer or the like.

The heat roller 53 is a cylindrical member made of metal. For example, the heat roller 53 may be made of a material having good heat resistance properties, such as an aluminum alloy.

Both ends of the heat roller 53 are rotatably supported by a supporting member (not shown) in the fixing section 51 via bearings (not shown). The heat roller 53 extends along a central axis $O_2$. The center axis $O_2$ extends in a width direction Y orthogonal to the conveyance direction which is a depth direction shown in FIG. 3. The conveyance direction X and the conveyance orthogonal direction Y are only shown in FIG. 3, FIG. 4, and FIG. 6.

The heat roller 53 is rotatable around the central axis $O_2$. At an end in the conveyance orthogonal direction Y of the heat roller 53, a gear (not shown) is provided. The gear transmits a rotational driving force to the heat roller 53. The rotational driving force transmitted by the gear is generated by a driving motor 87*a* (refer to FIG. 5). The rotational driving force generated by the driving motor 87*a* is transmitted to the gear via a transmission mechanism (not shown) connected to the driving motor 87*a*.

If the rotational driving force is transmitted to the gear, the heat roller 53 rotates in a clockwise direction shown in FIG. 3 about the central axis $O_2$.

Inside the heat roller 53, the center lamp 54 and the side lamp 55 described above are inserted. For example, the lamps 54 and 55 can be halogen lamps. The lamps 54 and 55 generate heat to heat the fixing belt 56 via the heat roller 53.

Figure 6:
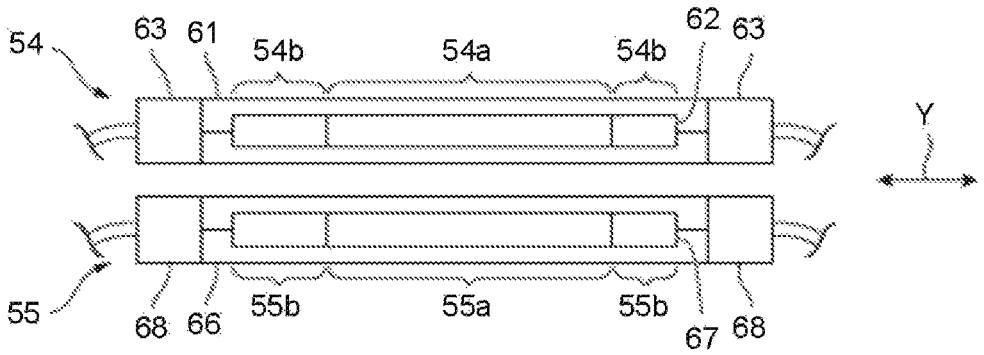
FIG. 6 is a side view of a center lamp and a side lamp of the image processing apparatus according to the embodiment.

As shown in FIG. 6, the center lamp 54 has a glass tube 61, a filament 62, and a base 63. The glass tube 61 is formed into a cylindrical shape the diameter of which varies according to the Y position. Each end of the glass tube 61 and the filament 62 in the conveyance orthogonal direction Y is sealed with the base 63. An inert gas or the like (not shown) is enclosed between the glass tube 61 and the filament 62. The center lamp 54 includes a first heating section 54*a* formed at the center thereof in the conveyance orthogonal direction Y and second heating sections 54*b* formed at both ends thereof in the conveyance orthogonal direction Y. Each of the second heating sections 54*b* is connected to the first heating section 54*a*. For example, the total length of the filament 62 is about 200 mm. The length of the first heating section 54*a* is about 120 mm-180 mm.

Figure 7:
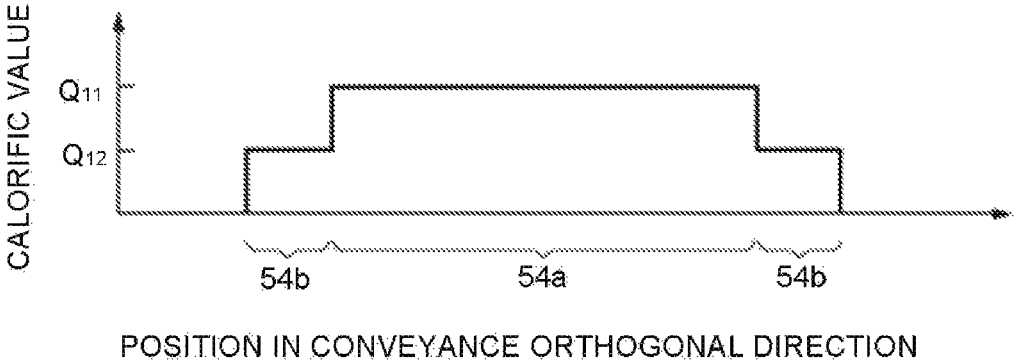
FIG. 7 is a diagram illustrating a calorific value with respect to a position in a conveyance orthogonal direction in the center lamp of the image processing apparatus according to the embodiment.

FIG. 7 shows the calorific value per unit length in the conveyance orthogonal direction X with respect to the position in the conveyance orthogonal direction Y of the center lamp 54. A calorific value $Q_{11}$ per unit length in the conveyance orthogonal direction X of the first heating section 54*a* is larger than a calorific value $Q_{12}$ per unit length in the conveyance orthogonal direction X of each second heating section 54*b*.

As shown in FIG. 6, the side lamp 55 is constituted in the same manner as the center lamp 54 except that a part which generates large calorific value is different from that of the center lamp 54. The side lamp 55 has a glass tube 66, a filament 67, and a base 68. The glass tube 66 is formed into a cylindrical shape, the diameter of which varies according to the Y position. Each end of the glass tube 66 and the filament 67 in the conveyance orthogonal direction Y is sealed by the base 68. An inert gas or the like (not shown) is enclosed between the glass tube 66 and the filament 67. The side lamp 55 includes a first heating section 55*a* formed at the center thereof in the conveyance orthogonal direction Y and second heating sections 55*b* formed at both ends thereof in the conveyance orthogonal direction Y. Each of the second heating sections 55*b* is connected to the first heating section 55*a*.

In the present embodiment, in the conveyance orthogonal direction Y, a position where the first heating section 54*a* of the center lamp 54 is disposed and a position where the first heating section 55*a* of the side lamp 55 is disposed are equal to each other. In the conveyance orthogonal direction Y, the position and range where the second heating section 54*b* of the center lamp 54 is disposed in the conveyance orthogonal direction Y and the position where the second heating section 55*b* of the side lamp 55 is disposed are to the same each other.

Figure 8:
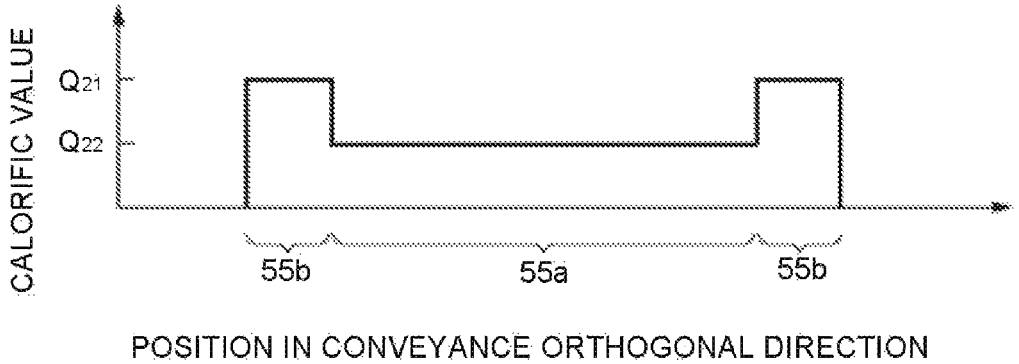
FIG. 8 is a diagram illustrating a calorific value with respect to the position in the conveyance orthogonal direction in the side lamp of the image processing apparatus according to the embodiment.
Figure 9:
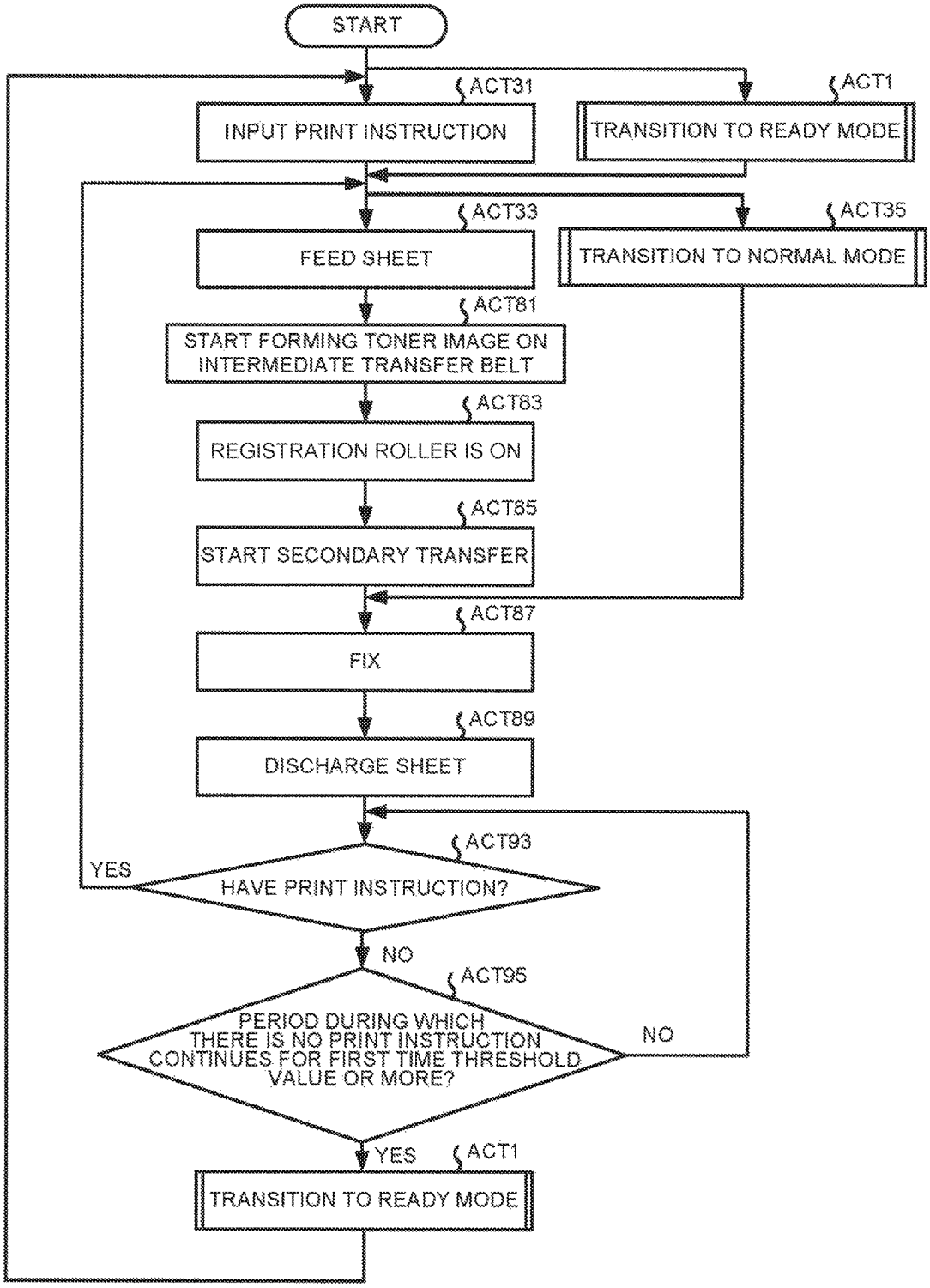
FIG. 9 is a flowchart depicting an example of the operation at the time of printing by the image processing apparatus according to the embodiment.
Figure 10:
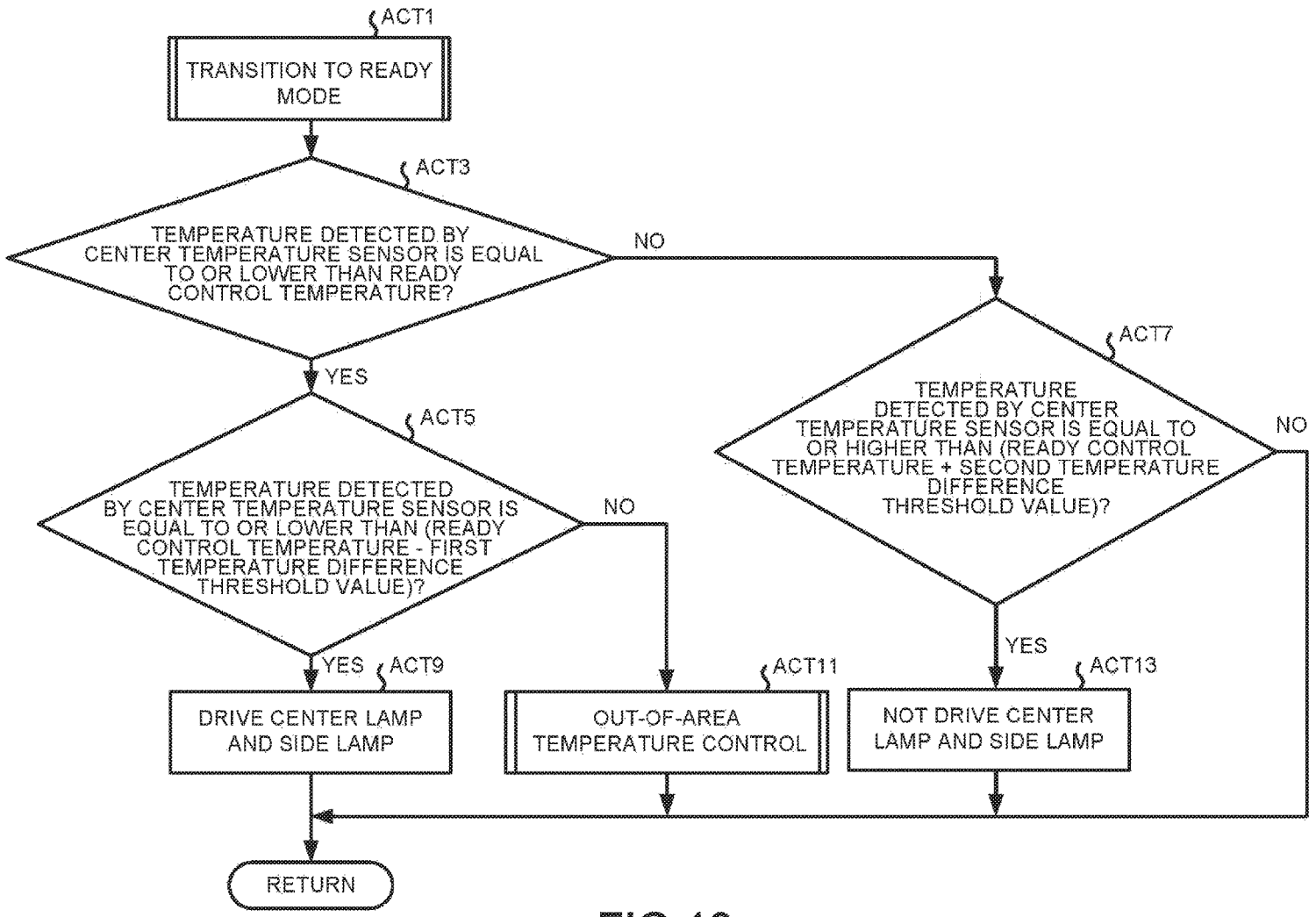
FIG. 10 is a flowchart depicting steps of a subroutine of a shift operation to a ready mode in the flowchart of FIG. 9.

FIG. 8 shows the calorific value per unit length in the conveyance orthogonal direction X with respect to the position in the conveyance orthogonal direction Y of the side lamp 55. A calorific value $Q_{22}$ per unit length in the conveyance orthogonal direction X of each second heating section 55*b* is larger than a calorific value $Q_{21}$ per unit length in the conveyance orthogonal direction X of the first heating section 55*a*.

For example, a value of $(Q_{22}/Q_{21})$ and a value of $(Q_{11}/Q_{12})$ described above are about 1.1-1.5. Furthermore, unless there is a proviso particularly, the lamps 54 and 55 are driven by being applied with a rated voltage (for example, 100 V).

Both ends of each of the lamps 54 and 55 respectively protrude to the outside of the heat roller 53. Both ends of the lamps 54 and 55 are supported by a lamp holder (not shown) in the fixing section 51.

The fixing belt 56 is an endless belt. The fixing belt 56 is rotated around the heat roller 53 and a pad 71 to convey the sheet P in the conveyance direction X as shown in FIG. 3. The fixing belt 56 is made of a heat resistant material resistant to heating by the heat roller 53. For example, a polyimide base material whose outer peripheral surface is coated with a PFA tube may be used in the fixing belt 56. On the outer peripheral surface of the fixing belt 56, a fluororesin as the release layer and a silicon rubber as the elastic layer may be laminated.

The fixing belt 56 is wrapped around the heat roller 53 and the pad 71 at an inner peripheral surface thereof. The pad 71 faces the press roller 52 across the fixing belt 56. The pad 71 is pressurized toward the outer circumferential surface of the press roller 52 by a spring or the like (not shown).

The press roller 52, the heat roller 53, the center lamp 54, the side lamp 55, and the fixing belt 56 are arranged in such a manner that the centers thereof in the conveyance orthogonal direction Y are coincident with each other. As shown in FIG. 4, a width $L_1$ of the fixing belt 56 (length of the conveyance orthogonal direction Y) is wider than the maximum width $L_2$ of the sheet P which is subjected to the image forming process in the image processing apparatus 1. For example, the maximum width $L_2$ of the sheet P is 215.9 mm which is a size of the letter paper in Europe and the United States.

Here, a heating area $R_1$ heated by at least one of the center lamp 54 and the side lamp 55 in the fixing belt 56 is defined. For example, in the conveyance orthogonal direction Y, the heating area $R_1$ is an area where anyone of the heating sections 54*a* and 54*b* of the center lamp 54 and the heating sections 55*a* and 55*b* of the side lamp 55 is arranged. The width of the heating area $R_1$ is narrower than the maximum width $L_2$ of the sheet P.

For example, the center temperature sensor 57 and the out-of-area temperature sensor 58 are thermistors. The temperature sensors 57 and 58 are in contact with the inner peripheral surface of the fixing belt 56. The center temperature sensor 57 detects the temperature of the center in the conveyance orthogonal direction Y of the heating area $R_1$ in the fixing belt 56. The center temperature sensor 57 does not detect the temperature of the end in the conveyance orthogonal direction Y of the heating area $R_1$ in the fixing belt 56. The out-of-area temperature sensor 58 detects the temperature of the outside of the heating area $R_1$ in the conveyance orthogonal direction Y of the fixing belt 56. It is preferable that the out-of-area temperature sensor 58 detects a temperature of the outside of the maximum width $L_2$ of the sheet P. As the temperature sensors 57 and 58, a non-contact type temperature sensor may be used.

The temperature sensors 57 and 58 transmit the result of temperature detection to the fixing control circuit 59.

As shown in FIG. 5, the fixing control circuit 59 has a computing circuit 59*a* and a memory 59*b*. The computing circuit 59*a* may include a processor such as a CPU (Central Processing Unit) or the like.

The memory 59*b* is composed of a random access memory (RAM) or the like. A control program executed by the computing circuit 59*a* is stored in the memory 59*b*. Further, the memory 59*b* stores values of a predetermined ready control temperature, a normal control temperature, a first temperature threshold value, a second temperature threshold value, a third temperature threshold value, a fourth temperature threshold value, a fifth temperature threshold value, a first time interval, a second time interval, a first time period threshold value, a second time period threshold value, and the like. The computing circuit 59*a* controls the driving motor and the lamps 54 and 55 of the fixing section 51 based on a control signal from a system controller 82 described later and detection results of the temperature sensors 57 and 58.

The control program stored in the memory 59*b* has a normal mode and a ready mode. In the normal mode, the fixing belt 56 is heated by the lamps 54 and 55 to such a degree that the fixing section 51 can fix the toner image transferred onto the sheet P. In the ready mode, the heating temperature of the fixing belt 56 is lower than that in the normal mode so as to reduce power consumption and to shift to the normal mode in a short time.

As shown in FIG. 1, a conveyance roller 76 is arranged at the downstream side (the upper left side in FIG. 1) of the fixing section 51 in the conveyance direction of the sheet P. The conveyance roller 76 discharges the sheet P to a sheet discharge section 77.

At the downstream side (right side in FIG. 1) of the fixing section 51 in the conveyance direction of the sheet P, an inversion conveyance path 78 is arranged. The inversion conveyance path 78 reverses the sheet P and guides it toward the secondary transfer roller 41. The inversion conveyance path 78 is used for duplex printing.

The configuration of the controller 81 of the image processing apparatus 1 is described below with reference to FIG. 5. However, in FIG. 5, for ease of view, the members distinguished by the subscripts Y, M, C and K are represented collectively by reference numerals from which these subscripts are deleted. For example, the photoconductive drum 27 represents the photoconductive drums 27Y, 27M, 27C and 27K. The same is true for the charging device 28, the developing device 29, and the primary transfer roller 30.

In the description with reference to FIG. 5, based on the description in FIG. 5, the reference numerals with the subscripts Y, M, C and K omitted may be used in some cases.

In FIG. 5, the controller 81 includes the system controller 82, a read only memory (ROM) 83, a random access memory (RAM) 84, an interface (I/F) 85, an input and output control circuit 86, a sheet feed and conveyance control circuit 87, and an image forming control circuit 88.

The system controller 82 controls the whole of the image processing apparatus 1. The system controller 82 realizes a processing function for image formation by executing a program stored in the ROM 83 or the RAM 84 described later. The system controller 82 is constituted in the same manner as the computing circuit 59*a* of the fixing section 51.

The ROM 83 stores the control program, control data, and the like that govern the basic operation of the image processing.

The RAM 84 is a working memory in the controller 81. For example, in the RAM 84, the control program or control data of the ROM 83 is loaded as necessary. Furthermore, the RAM 84 temporarily stores the image data sent from the input and output control circuit 86 or the data sent from the system controller 82.

The I/F 85 communicates with a device connected to the main body 11. For example, the scanner section 15 is connected to the I/F 85 in a communicable manner. Furthermore, an external device can be connected to the I/F 85. As examples of the external device, a user terminal, a facsimile machine, and the like are exemplified.

The input and output control circuit 86 controls the operation panel 14*a* and the operation and display section 14*b*. The input and output control circuit 86 sends the operation inputs received from the operation panel 14*a* and the operation and display section 14*b* to the system controller 82.

The sheet feed and conveyance control circuit 87 controls a driving system included in the main body 11. For example, the driving system includes the sheet feed mechanisms 19A and 19B, the sheet feed rollers 45A and 45B, the manual sheet feed mechanism 19C, and a driving motor 87*a* to drive the registration roller 46. More preferably, a plurality of the driving motors 87*a* is provided.

A plurality of sensors 87*b* is electrically connected to the sheet feed and conveyance control circuit 87. For example, the plurality of sensors 87*b* includes a plurality of sheet detection sensors. A plurality of the sheet detection sensors is arranged inside the conveyance path in the main body 11, or inside the sheet feed cassettes 18A and 18B and the manual sheet feed unit 18C. Each of the sheet detection sensors detects the presence or absence of the sheet P at the position thereof in the sheet conveyance direction of the conveyance path.

The detection result of each sensor 87*b* is sent from the sheet feed and conveyance control circuit 87 to the system controller 82.

The sheet feed and conveyance control circuit 87 controls the driving motor 87*a* based on a control signal from the system controller 82 and the detection result from the each sensor 87*b*.

Based on the control signal from the system controller 82, the image forming control circuit 88 controls the photoconductive drum 27, the charging device 28, the exposure device 23, the developing device 29, the primary transfer roller 30, and the secondary transfer roller 41, respectively.

Next, the operation of the image processing apparatus 1 and the control performed by the system controller 81 is described in detail.

The operation of the image processing apparatus 1 of the present embodiment constituted as stated above is described. FIG. 9 to FIG. 14 are flowcharts depicting an operation example at the time of printing by the image processing apparatus 1 in the embodiment.

The image processing apparatus 1 executes the processing in ACT 1 to ACT 95 shown in FIG. 9 to FIG. 14 according to the flowchart shown in FIG. 9 to FIG. 14, to print an image on the sheet P. The pre-set time interval for supplying the sheet P to the fixing section 51 is the first time interval.

In ACT 1, by supplying power to the image processing apparatus 1, the fixing section 51 shifts to the ready mode.

The system controller 82 sends a control signal to a fixing control circuit 59 of the fixing section 51 to start a warm-up operation of the fixing section 51. In ACT 1, the computing circuit 59*a* executes the processing in ACT 3 to ACT 13 shown in FIG. 10 according to the flowchart shown in FIG. 10.

In ACT 3, the computing circuit 59*a* reads out the ready control temperature from the memory 59*b*. For example, the ready control temperature is about 130 degrees centigrade. The computing circuit 59*a* determines whether or not the temperature detected by the center temperature sensor 57 is equal to or lower than the ready control temperature. If the temperature detected by the center temperature sensor 57 is equal to or lower than the ready control temperature (Yes in ACT 3), the processing in ACT 5 is executed. On the other hand, if the temperature detected by the center temperature sensor 57 exceeds the ready control temperature (No in ACT 3), the processing in ACT 7 is executed.

In ACT 5, the computing circuit 59*a* determines whether or not the temperature detected by the center temperature sensor 57 is equal to or lower than "the ready control temperature minus a first temperature difference threshold value". For example, the first temperature difference threshold value is about 5 degrees centigrade. If the temperature detected by the center temperature sensor 57 is equal to or lower than "the ready control temperature minus the first temperature difference threshold value" (Yes in ACT 5), the processing in ACT 9 is executed. On the other hand, if the temperature detected by the center temperature sensor 57 exceeds "the ready control temperature minus the first temperature difference threshold value" (No in ACT 5), the out-of-area temperature control in ACT 11 is executed.

In ACT 9, since the temperature detected by the center temperature sensor 57 is considerably low, the computing circuit 59*a* drives (lights up) the center lamp 54 and the side lamp 55, respectively, and heats the fixing belt 56. Then, all processes of ACT 1 are ended, and the processing in ACT 33 and ACT 35 (refer to FIG. 9) is executed. Details of the processing in ACT 11 are described later.

In ACT 7, the computing circuit 59*a* determines whether or not the temperature detected by the center temperature sensor 57 is equal to or higher than "the ready control temperature plus a second temperature difference threshold value". For example, the second temperature difference threshold value is about 5 degrees centigrade. If the temperature detected by the center temperature sensor 57 is equal to or higher than "the ready control temperature plus the second temperature difference threshold value" (Yes in ACT 7), the processing in ACT 13 is executed. On the other hand, if the temperature detected by the center temperature sensor 57 is lower than "the ready control temperature plus the second temperature difference threshold value" (No in ACT 7), all processes of ACT 1 are ended and the processing in ACT 33 and ACT 35 is executed.

In ACT 13, the computing circuit 59*a* does not drive (turn off) the center lamp 54 and the side lamp 55. In ACT 13, a voltage lower than the rated voltage may be applied to the center lamp 54 and the side lamp 55 to drive them.

Figure 11:
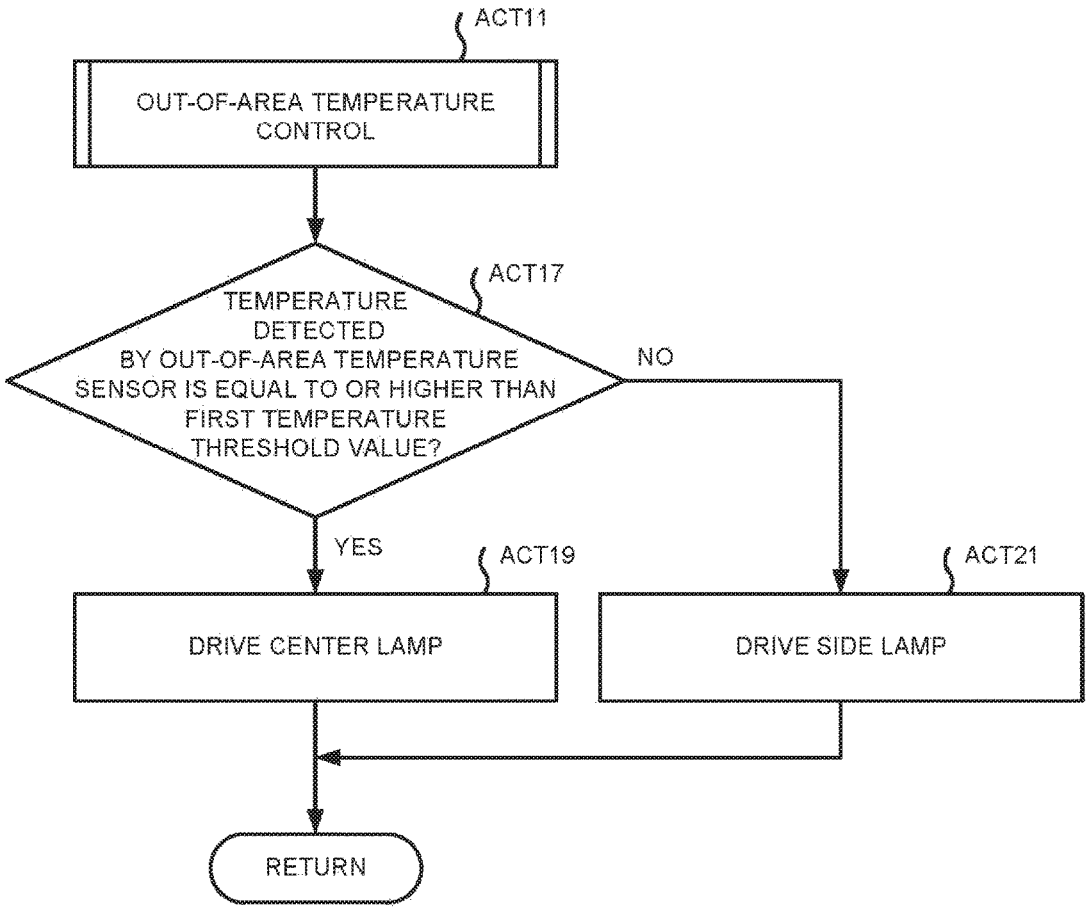
FIG. 11 is a flowchart depicting steps of a subroutine of an out-of-area temperature control of the shift operation to the ready mode.

Next, the out-of-area temperature control in ACT 11 is described with reference to FIG. 11.

In ACT 17, the computing circuit 59*a* determines whether or not the temperature detected by the out-of-area temperature sensor 58 is equal to or higher than the first temperature threshold value. For example, the first temperature threshold value is equal to the ready control temperature, or is about 10-20 degrees centigrade higher than the ready control temperature. If the temperature detected by the out-of-area temperature sensor 58 is equal to or higher than the first temperature threshold value (Yes in ACT 17), the processing in ACT 19 is executed. On the other hand, if the temperature detected by the out-of-area temperature sensor 58 is lower than the first temperature threshold value (No in ACT 17), the processing in ACT 21 is executed.

In ACT 19, since the temperature of the outside of the heating area $R_1$ in the fixing belt 56 is relatively high, the center lamp 54 is driven without driving the side lamp 55 to heat the fixing belt 56. Then, all processes of ACT 11 are completed, and the processing in ACT 33 and ACT 35 is executed.

In ACT 21, since the temperature of the outside of the heating area $R_1$ in the fixing belt 56 is relatively low, the side lamp 55 is driven without driving the center lamp 54 to heat the fixing belt 56. Then, all processes of ACT 11 are completed, and the processing in ACT 33 and ACT 35 is executed.

Returning to FIG. 9 and the description is continued.

In ACT 31, an operator inputs an instruction to start printing by, for example, enabling the image processing apparatus 1 to read the image data.

For example, the image data may be read by enabling the scanner section 15 to read an original document. In this case, the operator places the original document on the document table 12 or the ADF 13. Thereafter, the operator inputs a scanning start operation of the scanner section 15 through the operation section 14. The image data read by the scanner section 15 is stored in the RAM 84 through the I/F 85.

By operating the operation section 14, the operator selects any one of the sheets P accommodated in the sheet feed cassettes 18A and 18B and the manual sheet feed unit 18C for use. In this example, it is assumed that the sheet P accommodated in the sheet feed cassette 18A is selected. The print instruction (print JOB) for printing five sheets P having the letter paper sizes of European and United States accommodated in the sheet feed cassette 18A is input through the operation section 14 or the like.

After the sheet P is selected, the processing in ACT 31 ends. If the processing in ACT 31 and ACT 1 is terminated, the processing in ACT 33 and ACT 35 is executed.

Figure 12:
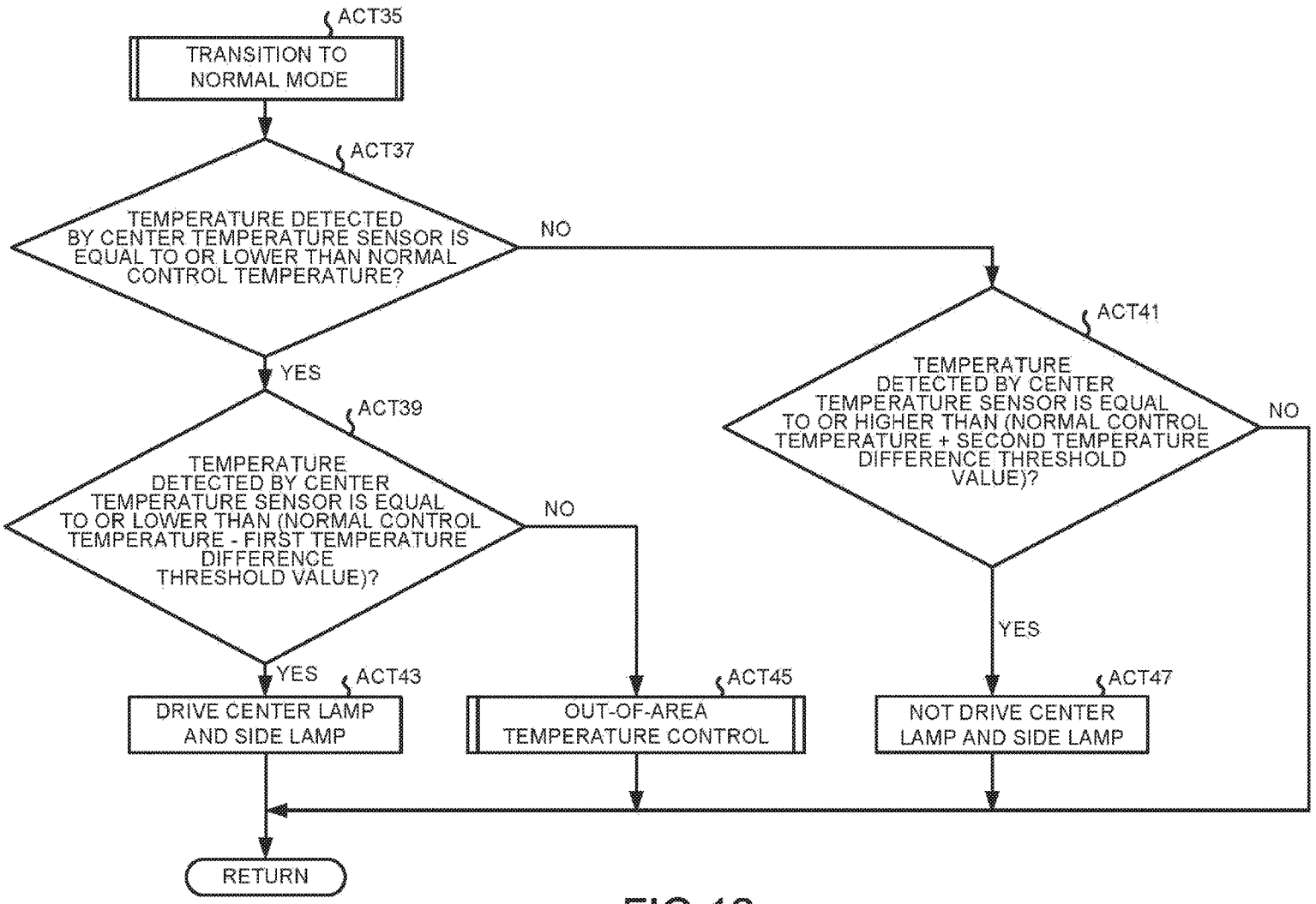
FIG. 12 is a flowchart depicting steps of a subroutine of a shift operation to a normal mode in the flowchart of FIG. 9.

In ACT 35, by inputting the print instruction, the operation mode of the fixing section 51 shifts from the ready mode to the normal mode. The transition to the normal mode in ACT 35 shown in FIG. 12 is a process of changing the ready control temperature to the normal control temperature with respect to the transition to the ready mode in ACT 1 shown in FIG. 10. For example, the normal control temperature is about 150 degrees centigrade, higher than the ready control temperature. The processing in ACTs 37, 39, 41, 43, 45 and 47 in the transition to the normal mode in ACT 35 corresponds to the processing in ACT 3, 5, 7, 9, 11 and 13 in transition to the ready mode in ACT 1. If a warm-up operation in the transition to the normal mode in ACT 35 is ended, the fixing control circuit 59 sends a conveyance start signal of the sheet P to the system controller 82.

Figure 13:
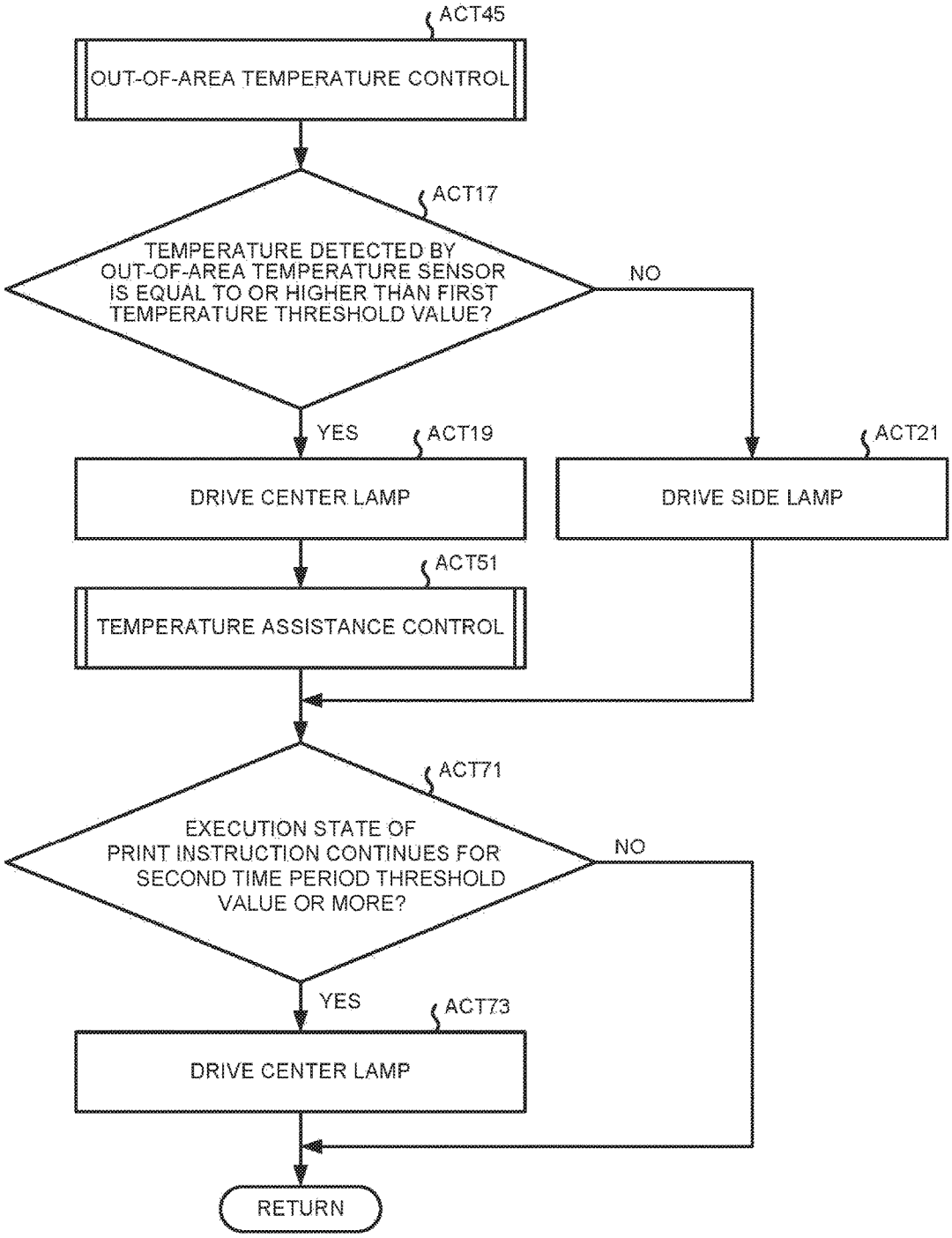
FIG. 13 is a flowchart depicting steps of a subroutine of the out-of-area temperature control of the shift operation to the normal mode.

Here, the out-of-area temperature control in ACT 45 in the transition to the normal mode in ACT 35 is described with reference to FIG. 13. The processing in ACT 17 to ACT 21 in the out-of-area temperature control in ACT 45 is basically the same as that in ACT 17 to ACT 21 in the out-of-area temperature control in ACT 11. However, the first temperature threshold value in ACT 17 in the out-of-area temperature control in ACT 45 is, for example, equal to the normal control temperature or a temperature about 10-20 degrees centigrade higher than the normal control temperature.

If the processing in ACT 19 ends, a temperature assistance control in ACT 51 is executed.

Figure 14:
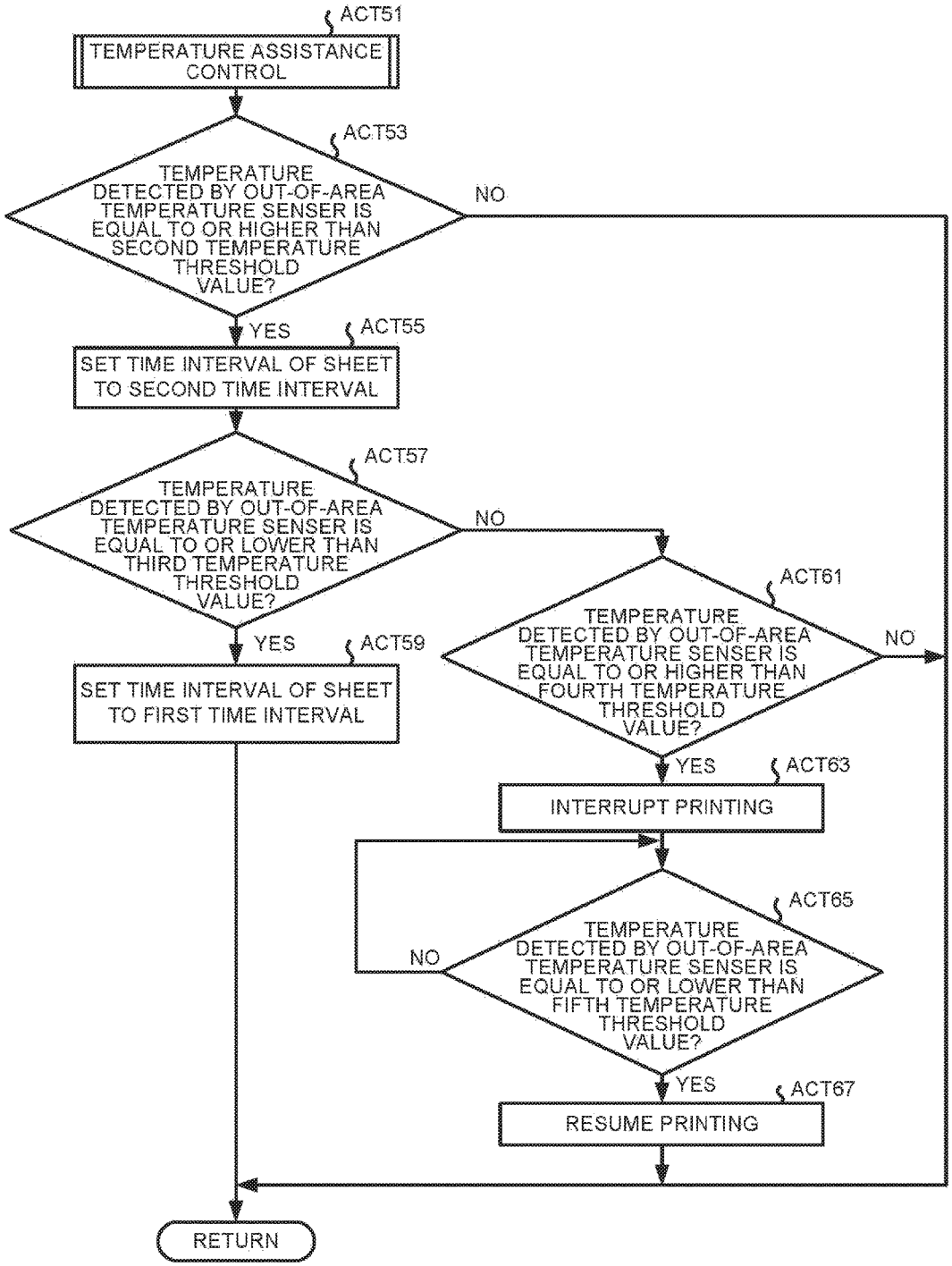
FIG. 14 is a flowchart depicting steps of a subroutine of a temperature assistance control in the flowchart of FIG. 9.

Next, the temperature assistance control in ACT 51 is described with reference to FIG. 14.

In ACT 53, the computing circuit 59*a* determines whether or not the temperature detected by the out-of-area temperature sensor 58 is equal to or higher than the second temperature threshold value. The second temperature threshold value is higher than the first temperature threshold value. If the temperature detected by the out-of-area temperature sensor 58 is equal to or higher than the second temperature threshold value (Yes in ACT 53), the processing in ACT 55 is executed. On the other hand, if the temperature detected by the out-of-area temperature sensor 58 is lower than the second temperature threshold value (No in ACT 53), all processes of ACT 51 are terminated and the processing in ACT 71 (refer to FIG. 13) is executed.

In ACT 55, the computing circuit 59*a* sets a time interval for supplying the sheet P to the fixing section 51 to the second time interval. The second time interval is longer than the first time interval. As the time interval for supplying the sheet P increases, the temperature of the outside of the heating area $R_1$ in the fixing belt 56 is controlled to decrease. After setting the time interval of the sheet P to the second time interval, the processing in ACT 55 is ended and the processing in ACT 57 is executed.

In ACT 57, the computing circuit 59*a* determines whether or not the temperature detected by the out-of-area temperature sensor 58 is equal to or lower than the third temperature threshold value. If the temperature detected by the out-of-area temperature sensor 58 is equal to or lower than the third temperature threshold value (Yes in ACT 57), the processing in ACT 59 is executed. On the other hand, if the temperature detected by the out-of-area temperature sensor 58 is higher than the third temperature threshold value (No in ACT 57), the processing in ACT 61 is executed. The third temperature threshold value is lower than the second temperature threshold value.

In ACT 59, the computing circuit 59*a* sets the time interval of the sheet P supplied to the fixing section 51 from the second time interval to the first time interval. Then, all processes of the ACT 51 are ended, and the processing in ACT 71 is executed.

In ACT 61, if the rise in the temperature detected by the out-of-area temperature sensor 58 continues, the computing circuit 59*a* determines whether or not the temperature detected by the out-of-area temperature sensor 58 is equal to or higher than the fourth temperature threshold value. The fourth temperature threshold value is higher than the second temperature threshold value. If the temperature detected by the out-of-area temperature sensor 58 is equal to or higher than the fourth temperature threshold value (Yes in ACT 61), the processing in ACT 63 is executed. On the other hand, if the temperature detected by the out-of-area temperature sensor 58 is lower than the fourth temperature threshold value (No in ACT 61), all processes of ACT 51 are terminated, and the processing in ACT 71 is executed.

In ACT 63, the computing circuit 59*a* interrupts printing of the sheet P. If the printing of the sheet P is interrupted, the operation and display section 14*b* may display a message for attracting the attention of the operator. After interrupting the printing of the sheet P, the processing in the ACT 63 is terminated and the processing in the ACT 65 is executed.

In ACT 65, the computing circuit 59*a* determines whether or not the temperature detected by the out-of-area temperature sensor 58 is equal to or lower than the fifth temperature threshold value. If the temperature detected by the out-of-area temperature sensor 58 is equal to or lower than the fifth temperature threshold value (Yes in ACT 65), the processing in ACT 67 is executed. On the other hand, if the temperature detected by the out-of-area temperature sensor 58 is higher than the fifth temperature threshold value (No in ACT 65), the processing in ACT 65 is executed again.

In ACT 67, the computing circuit 59*a* resumes the interrupted printing of the sheet P. Then, all processes of the ACT 51 are ended, and the processing in ACT 71 is executed.

Returning to FIG. 13 and the description is continued.

In ACT 71, the computing circuit 59*a* determines whether or not the execution state of the print instruction continues for the second time period threshold value or more. If the execution state of the print instruction continues for the second time period threshold value or more (Yes in ACT 71), the processing in ACT 73 is executed. On the other hand, if the execution state of the print instruction continues for a time lower than the second time period threshold value (No in ACT 71), the processing in ACT 87 (refer to FIG. 9) is executed.

In ACT 73, the printing is continued and the temperature of the outside of the heating area $R_1$ is relatively high, the computing circuit 59*a* drives the center lamp 54 without driving the side lamp 55 to heat the fixing belt 56. Then, all processes of ACT 45 are ended and the processing in ACT 87 is executed.

Here, a plurality of the second time period threshold values may be stored in the memory 59*b* of the fixing control circuit 59 in response to the length of the conveyance orthogonal direction Y of the sheet P. For example, as the length in the conveyance orthogonal direction Y of the sheet P becomes shorter, the second time period threshold value can become smaller. As the length in the conveyance orthogonal direction Y of the sheet P becomes shorter, the temperature of the outside of the heating area $R_1$ in the fixing belt 56 tends to be higher, and therefore the control is performed in this manner.

Returning to FIG. 9 and the description is continued.

In ACT 33, the sheet P selected in ACT 31 is fed.

Specifically, the system. controller 82 sends a control signal to start feeding the sheet P to the sheet feed and conveyance control circuit 87. The sheet feed and conveyance control circuit 87 controls feeding of the sheet P from the selected sheet feed cassette 18A based on the control signal from the system controller 82. The sheet P stops with the tip of the sheet P abutting against the registration roller 46 at the registration position a.

Through the above, the processing in ACT 33 is terminated and the processing in ACT 81 is executed.

In ACT 81, the image formation of a toner image onto the intermediate transfer belt 24 is started. Specifically, the system controller 82 determines whether the conveyance start signal is received from the fixing control circuit 59. If the conveyance start signal is received, the system controller 82 sends a control signal to start forming the toner image to the sheet feed and conveyance control circuit 87, the image forming control circuit 88, and the fixing control circuit 59.

The sheet feed and conveyance control circuit 87, the image forming control circuit 88, and the fixing control circuit 59 start controlling the operation respectively in parallel.

Through the above, the processing in ACT 81 is terminated and the processing in ACT 83 is executed.

The image forming control circuit 88 starts the image forming processes of the image forming sections 22Y, 22M, 22C and 22K in this order. In each of the image forming sections 22Y, 22M, 22C and 22K, an electrostatic latent image is formed on the surfaces of the photoconductive drums 27Y, 27M, 27C and 27K by exposure light $L_Y$, $L_M$, $L_C$ and $L_K$ from the exposure device 23. Each electrostatic latent image is developed by the developing devices 29Y, 29M, 29C and 29K.

The developed toner image is transferred onto the intermediate transfer belt 24 by the primary transfer rollers 30Y, 30M, 30C and 30K to perform the primary transfer. The toner images formed on the photoconductive drums 27Y, 27M, 27C and 27K are transferred respectively onto the intermediate transfer belt 24 such that the toner images transferred from the photoconductive drums 27Y, 27M, 27C and 27K are overlapped each other on the intermediate transfer belt 24. The toner image formed by stacking the toner images transferred from the photoconductive drums 27Y, 27M, 27C and 27K on the intermediate transfer belt 24 is conveyed towards the secondary transfer position b by the intermediate transfer belt 24.

In parallel with such an operation of the image forming control circuit 88, the processing in ACT 83 is executed. In ACT 83, at a timing at which the toner image reaches a predetermined position, the driving motor 87*a* for driving the registration roller 46 is driven by the sheet feed and conveyance control circuit 87. The rotation of the registration roller 46 is started by the driving motor 87*a*. The timing to start the rotation of the registration roller 46 is a timing at which the tip of the transfer area of the sheet P, onto which the toner image will be transferred, reaches the secondary transfer position b when the tip of the toner image on the intermediate transfer belt 24 reaches the secondary transfer position b.

Through the above, the processing in ACT 83 is terminated and the processing in ACT 85 is executed.

In ACT 85, the toner image on the intermediate transfer belt 24 is transferred onto the sheet P to perform the secondary transfer. Specifically, the sheet feed and conveyance control circuit 87 rotates the driving roller 39 at a predetermined rotation speed. The image forming control circuit 88 applies the secondary transfer voltage to the secondary transfer roller 41 until the tip of the sheet P reaches the secondary transfer position b. The toner image is transferred onto the sheet P passing through the secondary transfer position b to perform the secondary transfer. The sheet P that passes through the secondary transfer position b is conveyed along the conveyance path towards the fixing section 51.

The image forming control circuit 88 stops applying the secondary transfer voltage after a rear end of the sheet P passes through the secondary transfer position b. Through the above, the processing in ACT 85 is terminated.

If the sheet P passing through the secondary transfer position b enters the fixing section 51, the processing in ACT 87 is executed. In ACT 87, the toner image is fixed on the sheet P by the fixing section 51. The fixing belt 56 is heated to an appropriate temperature by the lamps 54 and 55. The toner image is fixed on the sheet P passing between the press roller 52 and the fixing belt 56 by the heat of the lamps 54 and 55.

Through the above, the processing in ACT 87 is terminated, and the processing in ACT 89 is executed.

In ACT 89, the sheet P is discharged. The sheet P discharged from the fixing section 51 reaches the conveyance roller 76. The conveyance roller 76 discharges the sheet P to the sheet discharge section 77.

Through the above, the image formation on one sheet P is terminated. The processing in ACT 89 is terminated, and the processing in ACT 93 is executed.

In ACT 93, the system controller 82 determines whether or not there is the print instruction. In this example, only one sheet P is printed, and the print instruction for four sheets remains. Therefore, it is determined that there is the print instruction (Yes in ACT 93), the processing in ACT 33 and ACT 35 is executed. If the processing from. ACT 33 and ACT 35 to ACT 93 is repeated 4 times, the print instruction disappears. If it is determined that print instruction is not received (No in ACT 93), the processing in ACT 95 is executed.

In ACT 95, the computing circuit 59*a* determines whether or not the state in which print instruction is not received continues for the first time period threshold value. If the state in which print instruction is not received continues for the first time period threshold value (Yes in ACT 95), the processing in ACT 1 is executed and then the processing in ACT 31 is executed. On the other hand, if the state in which print instruction is not received does not continue for the first time period threshold value (No in ACT 95), the processing in ACT 93 is executed.

Since the conventional fixing section has three temperature sensors, there is a problem that the manufacturing cost of the fixing section is high.

On the other hand, according to the fixing section 51 of the present embodiment, two temperature sensors 57 and 58 are provided in total. Since the temperature sensor for detecting the temperature of the end of the heating area $R_1$ in the fixing belt 56 becomes unnecessary, the manufacturing cost of the fixing section 51 can be reduced.

The fixing section 51 includes the fixing control circuit 59 which performs the out-of-area temperature control. This makes it possible to selectively use the temperature sensors 57 and 58 to be driven according to the temperature of the outside of the heating area $R_1$ in the fixing belt 56.

If the state in which print instruction is not received continues for the first time period threshold value, the temperature of the fixing belt 56 is considered to be high. By performing the out-of-area temperature control on the fixing belt 56, the fixing belt 56 can be heated to an appropriate temperature.

The fixing control circuit 59 increases the time interval of the sheet P to the second time interval if the temperature detected by the out-of-area temperature sensor 58 is equal to or higher than the second temperature threshold value. Therefore, it is possible to lower the temperature of the outside of the heating area $R_1$ in the fixing belt 56.

If the temperature detected by the out-of-area temperature sensor 58 becomes equal to or lower than the third temperature threshold value, the time interval of the sheet P is returned to the first time interval. Thereby, the printing efficiency of the sheet P can be improved.

The fixing control circuit 59 interrupts the printing of the sheet P if the temperature detected by the out-of-area temperature sensor 58 is equal to or higher than the fourth temperature threshold value. Therefore, it is possible to reliably lower the temperature of the outside of the heating area $R_1$ in the fixing belt 56.

If the temperature detected by the out-of-area temperature sensor 58 becomes equal to or lower than the fifth temperature threshold value after the printing of the sheet P is interrupted, the fixing control circuit 59 resumes printing of the sheet P. Therefore, even after the printing of the sheet P is interrupted, it is possible to perform printing on the sheet P based on the temperature of the outside of the heating area $R_1$ of the fixing belt 56.

The fixing control circuit 59 drives the center lamp 54 without driving the side lamp 55 to heat the fixing belt 56 if the execution state of the print instruction continues for the second time period threshold value or more. If the printing of the sheet P continues, the temperature of the outside of the heating area $R_1$ of the fixing belt 56 tends to be high. By driving only the center lamp 54, it is possible to lower the temperature of the outside of the heating area $R_1$ in the fixing belt 56.

As the length in the conveyance orthogonal direction Y of the sheet P becomes shorter, the second time period threshold value gradually decreases. Therefore, even if the length of the conveyance orthogonal direction Y of the sheet P is shortened and the temperature of the outside of the heating area $R_1$ tends to be high, it is also possible to lower the temperature of the outside of the heating area $R_1$ in the fixing belt 56.

Furthermore, according to the image processing apparatus 1 of the present embodiment, the image processing apparatus 1 can be constituted using the fixing section 51 whose manufacturing cost is reduced.

In the operation example at the time of printing of the image processing apparatus 1 according to the present embodiment, it is not necessary to perform the processing in ACT 53, 55, 57, 59, 61, 63, 65, 67, 71, 73 and 95.

In the present embodiment, the fixing section 51 may not include the fixing control circuit 59. Although the rotating body is assumed to be the fixing belt 56, the rotating body may be the heat roller 53 or the like.

According to at least one embodiment described above, by including one center lamp 54 and one side lamp 55, the manufacturing cost of the fixing section 51 can be reduced.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing apparatus, comprising:

a rotating body configured to convey a sheet in a first direction by rotating;

a first heating section configured to heat the rotating body and in which a calorific value per unit length in a second direction orthogonal to the first direction, at the center of the first heating section in the second direction is larger than that at both ends of the first heating section in the second direction;

a second heating section configured to heat the rotating body and in which a calorific value per unit length in the second direction, at both ends of the second heating section in the second direction is larger than that at the center of the second heating section in the second direction;

a first temperature detector configured to detect a temperature of a central part of a heating area of the rotating body in the second direction, that is heated by at least one of the first heating section and the second heating section;

a second temperature detector configured to detect a temperature outside of the heating area of the rotating body in the second direction; and a fixing controller configured to perform an out-of-area temperature control to drive the second heating section to heat the rotating body in a case where the temperature detected by the second temperature detector is lower than a first temperature threshold value, and drive the first heating section to heat the rotating body in a case where the temperature detected by the second temperature detector is equal to or higher than the first temperature threshold value at the time the temperature detected by the first temperature detector is equal to or lower than a predetermined internal temperature threshold value.

2. The fixing apparatus according to claim 1, wherein the fixing controller performs the out-of-area temperature control after a state in which there is no print instruction continues for a time period threshold value.

3. The fixing apparatus according to claim 1, wherein if the temperature detected by the second temperature detector is equal to or higher than the first temperature threshold value, in a case where the temperature detected by the second temperature detector is equal to or higher than a second temperature threshold value higher than the first temperature threshold value, the fixing controller increases a time interval of the sheet supplied to the fixing apparatus from a first time interval to a second time interval longer than the first time interval.

4. The fixing apparatus according to claim 3, wherein if the temperature detected by the second temperature detector becomes equal to or lower than a third temperature threshold value after setting the time interval of the sheet to the second time interval, the fixing controller sets the time interval of the sheet supplied to the fixing apparatus from the second time interval to the first time interval.

5. The fixing apparatus according to claim 3, wherein if the temperature detected by the second temperature detector continues to rise after setting the time interval of the sheet to the second time interval, the fixing controller interrupts printing of the sheet if the temperature detected by the second temperature detector is equal to or higher than a third temperature threshold value.

6. The fixing apparatus according to claim 5, wherein if the temperature detected by the second temperature detector becomes equal to or lower than a fourth temperature threshold value after interrupting printing of the sheet, the fixing controller resumes printing of the sheet.

7. The fixing apparatus according to claim 1, wherein the fixing controller drives the first heating section to heat the rotating body if an execution state of a print instruction continues for a time period threshold value or more.

8. The fixing apparatus according to claim 7, wherein the fixing controller gradually decreases the time period threshold value as the length in the second direction of the sheet becomes shorter.

9. An image processing apparatus, comprising a fixing apparatus, wherein the fixing apparatus comprises:

a rotating body configured to convey a sheet in a first direction by rotating;

a first heating section configured to heat the rotating body and in which a calorific value per unit length in a second direction orthogonal to the first direction, at the center of the first heating section in the second direction is larger than that at both ends of the first heating section in the second direction;

a second heating section configured to heat the rotating body and in which a calorific value per unit length in the second direction, at both ends of the second heating section in the second direction is larger than that at the center of the second heating section in the second direction;

a first temperature detector configured to detect a temperature of a central part of a heating area of the rotating body in the second direction, that is heated by at least one of the first heating section and the second heating section;

a second temperature detector configured to detect a temperature outside of the heating area of the rotating body in the second direction; and a fixing controller configured to perform an out-of-area temperature control to drive the second heating section to heat the rotating body in a case where the temperature detected by the second temperature detector is lower than a first temperature threshold value, and drive the first heating section to heat the rotating body in a case where the temperature detected by the second temperature detector is equal to or higher than the first temperature threshold value at the time the temperature detected by the first temperature detector is equal to or lower than a predetermined internal temperature threshold value.

10. The image processing apparatus according to claim 9, wherein the fixing controller performs the out-of-area temperature control after a state in which there is no print instruction continues for a time period threshold value.

11. The image processing apparatus according to claim 9, wherein if the temperature detected by the second temperature detector is equal to or higher than the first temperature threshold value, in a case where the temperature detected by the second temperature detector is equal to or higher than a second temperature threshold value higher than the first temperature threshold value, the fixing controller increases a time interval of the sheet supplied to the fixing apparatus from a first time interval to a second time interval longer than the first time interval.

12. The image processing apparatus according to claim 11, wherein if the temperature detected by the second temperature detector becomes equal to or lower than a third temperature threshold value after setting the time interval of the sheet to the second time interval, the fixing controller sets the time interval of the sheet supplied to the fixing apparatus from the second time interval to the first time interval.

13. The image processing apparatus according to claim 11, wherein if the temperature detected by the second temperature detector continues to rise after setting the time interval of the sheet to the second time interval, the fixing controller interrupts printing of the sheet if the temperature detected by the second temperature detector is equal to or higher than a third temperature threshold value.

14. The image processing apparatus according to claim 13, wherein if the temperature detected by the second temperature detector becomes equal to or lower than a fourth temperature threshold value after interrupting printing of the sheet, the fixing controller resumes printing of the sheet.

15. The image processing apparatus according to claim 9, wherein the fixing controller drives the first heating section to heat the rotating body if an execution state of a print instruction continues for a time period threshold value or more.

16. The image processing apparatus according to claim 15, wherein the fixing controller gradually decreases the time period threshold value as the length in the second direction of the sheet becomes shorter.

* * * * *